US005906665A

United States Patent [19]

Trippe et al.

[11] Patent Number: 5,906,665

[45] Date of Patent: May 25, 1999

[54] HIGH MOLECULAR WEIGHT FUEL ADDITIVE

[75] Inventors: Jerry C. Trippe, Fairfax, Va.; Albert F. Hadermann, Ijamsville, Md.; James A. Cole, Haymarket, Va.

[73] Assignee: General Technology Applications, Inc., Manassas, Va.

[21] Appl. No.: 08/719,272

[22] Filed: Sep. 24, 1996

Related U.S. Application Data

[60] Provisional application No. 60/004,295, Sep. 26, 1995.

[51] Int. Cl.[6] ..... C10L 1/16

[52] U.S. Cl. ..... 44/459; 44/300; 44/603; 585/10; 524/579

[58] Field of Search ..... 524/579, 490, 524/491, 585; 526/348.7; 44/58, 62, 275, 459, 544, 628, 300, 603; 585/10

[56] References Cited

U.S. PATENT DOCUMENTS

| | | | |
|---|---|---|---|
| 3,215,154 | 11/1965 | White et al. | 585/40 X |
| 3,338,855 | 8/1967 | Kray | 524/579 X |
| 3,547,819 | 12/1970 | Davis et al. | 524/585 X |
| 3,615,284 | 10/1971 | Cassar . | |
| 3,692,676 | 9/1972 | Culter et al. | 585/10 X |
| 3,734,875 | 5/1973 | Sekuler | 524/579 X |
| 3,801,508 | 4/1974 | Meier et al. | 585/10 |
| 3,996,023 | 12/1976 | Osmond et al. | 44/459 |
| 4,379,899 | 4/1983 | Marsh | 526/348.7 X |
| 4,510,304 | 4/1985 | Hadermann | 528/481 |
| 4,546,748 | 10/1985 | Karino et al. | 123/494 |
| 4,753,661 | 6/1988 | Nelson et al. | 44/309 |
| 4,789,383 | 12/1988 | O'Mara et al. | 44/459 |
| 4,837,249 | 6/1989 | O'Mara et al. | 523/175 |
| 4,997,594 | 3/1991 | Walsh | 252/51.5 A |
| 5,227,083 | 7/1993 | Russo et al. | 554/35 X |
| 5,358,651 | 10/1994 | Walsh | 252/51.5 A |

FOREIGN PATENT DOCUMENTS

| | | | |
|---|---|---|---|
| 1490156 | 4/1969 | Germany | 524/579 |
| 0482547 | 3/1938 | United Kingdom | 524/579 |

OTHER PUBLICATIONS

Hackh's Chem. Dictionary, 4th ed., McGraw–Hill, N.Y., p. 396, 1969.

Modern Plastics Encyclopedia, Oct. 1980, vol. 57, No. 10A, p. 214, Oct. 1980.

*Primary Examiner*—Fred Teskin

*Attorney, Agent, or Firm*—Ostrolenk, Faber, Gerb & Soffen, LLP

[57] ABSTRACT

A method and composition for improving the mechanical efficiency of a engine is provided. Ultra-high molecular weight polyisobutylene (PIB) added to the fuel changes the momentary mechanical properties of the fuel during induction. The additive provides a more uniform spray droplet size, increases the extensional viscosity of the fuel, and adapts other physical properties, under induction conditions.

17 Claims, No Drawings

HIGH MOLECULAR WEIGHT FUEL ADDITIVE

This application claims the benefit of U.S. Provisional Application No. 60/004,295, filed Sep. 26, 1995.

BACKGROUND OF THE INVENTION

1. Field of the Invention

The present invention relates to the use of fuel additives in liquid fuels to improve the efficiency of fuel-burning devices such as engines and furnaces. More specifically, the present invention relates to high molecular weight fuel additives that change the physical properties of fuel under the dynamic conditions of fuel atomization and vaporization. The invention also relates to additive concentrates and fuel compositions containing the additive.

2. Description of the Related Art

Sixty percent of the energy in gasoline is not converted to useful mechanical energy in the combustion process. Chemists cannot safely put more energy in gasoline. Engineers are designing changes in the induction system, cylinder head and piston of engines to improve engine efficiency; however, their options are limited.

Known fuel additives, many of which are commercially available under several well-known brand names, enhance the performance of the fuels to which they are added only to the extent that the additives themselves are fuels. In addition, prior art fuel additives are claimed to provide lubrication to fuel and thereby reduce the friction in an engine; however, none of the prior art fuel additives are known to adapt the physical properties of the fuel in order to enhance engine performance.

Low concentrations of relatively high molecular weight polymers, such as high molecular weight polyisobutylene, are known to reduce flow turbulence and have been used as drag-reducing additives. See U.S. Pat. Nos. 4,546,748 and 4,837,249. High molecular weight alpha-olefins are known as anti-misting additives for fuels to reduce flammability of fuel sprays occurring during aircraft crashes. See U.S. Pat. No. 4,789,383, assigned to the assignee of the present application, the disclosure of which defines high molecular weight polymers as including Oppanol® B200 (polyisobutylene having a molecular weight of about 4 million daltons) and very high molecular weight polymers as those above 5 million daltons, and is incorporated herein by reference. However, the use of high molecular weight polymers to change the physical properties of fuel and improve combustion efficiency has not heretofore been suggested.

SUMMARY OF THE INVENTION

The present invention overcomes the deficiencies of the prior art noted above by providing a method of improving the mechanical efficiency of fuel-burning devices, such as gasoline engines, diesel engines, furnaces and burners, by adding an effective amount of a high-molecular weight polymer to the fuel.

The preferred additive for desirably modifying fuel properties is ultra-high molecular weight polyisobutylene (polyisobutene). The polyisobutylene (PIB) is added to the fuel in a concentration range of between 0.1–100 ppm by weight. PIB is a pure hydrocarbon which burns to carbon dioxide and water vapor, or decomposes cleanly to gaseous isobutene which also burns to carbon dioxide and water vapor.

The fundamental polymer property which makes PIB a good candidate for use as a fuel additive which increases combustion efficiency is its extended molecular length. Thus, other monomers can be polymerized with isobutene, and the resulting copolymers would also be combustion improvers at sufficiently high molecular weights. Indeed, any high molecular weight polymer, copolymer, terpolymer (or higher combination of monomers) which is soluble in hydrocarbon fuel would be similar to high molecular weight PIB in action and would confer non-Newtonian characteristics upon a fuel and a fuel spray to improve fuel efficiency.

As an example, high molecular weight polymers developed for hydrocarbon drag reduction confer non-Newtonian behavior upon a fuel and a fuel spray, and can be used in the method of the present invention. U.S. Pat. No. 4,384,089 teaches a method for making a very high molecular weight polyalphaolefin polymer for increasing the throughput of hydrocarbon liquids flowing through a pipeline. One, two, or more monomers are reacted to produce hydrocarbon polymer molecules in solution.

High molecular weight drag reduction polymers which contain elements in addition to carbon and hydrogen would also be useful in the method of the present invention. An example of such a drag reduction polymer is taught in U.S. Pat. No. 4,508,128. U.S. Pat. Nos. 4,573,488 and 5,080,121 also disclose drag reduction polymers that contain elements in addition to carbon and hydrogen.

Without being limited to any particular theory of operation, the effectiveness of the present invention is believed to be related to a suppression in the formation of sub-50-micron diameter droplets as the fuel is sprayed. In addition, based on the present understanding of the invention, the additive of the present invention increases the momentary, or extensional, viscosity of the fuel droplets under conditions such as those encountered in engine fuel and combustion systems. Other physical properties of the fuel are also believed to be affected, including the surface tension and relative rigidity of the fuel droplets. A standard research octane number test showed an increase in octane number with a low concentration of high molecular weight polyisobutylene.

The modification of the physical properties of the fuel by adding high molecular weight polyisobutylene controls the rate at which fuel components vaporize. Fuel droplet size is more uniform. The polymeric additive of the present invention suppresses formation of very small droplets.

The momentary viscosity of spray droplets of fuel containing a low concentration of a very high molecular weight viscoelastic polymer is greatly increased over that of neat fuel. The changes in the fuel made by the additive, in particular, the physical properties of the fuel, result in reduced vaporization of the fuel during the intake stroke of the engine, and thereby increases the volumetric efficiency of 4- and 2-cycle ignition engines. A momentary increase of the viscosity of a fuel droplet also retards the fractional distillation of smaller fuel molecules, making the final fuel air mixture more homogeneous.

The extended polymer molecules can only relax by a thermal mechanism, over a millisecond duration period, which increases with molecular weight. This second transient effect of the high molecular weight polymer is especially significant where induction, vaporization, and combustion events are changing quickly with time, e.g., heavy load, rapid acceleration, and combinations of loading and acceleration. Very small concentrations of the additive are required.

The concentration of polymer in the fuel typically is 1 to 20 ppm. At these low concentrations, it is unlikely that the polymer could be involved in the process of combustion in a strict chemical, as distinguished from a purely physical-chemical, sense. It is known, however, that the polyisobutylene preferably used in this fuel additive is the most pure commercial grade of polyisobutylene available today. When heated in a vacuum at 200° C., the cold trap fills with pure, water-white isobutylene. The residue shows no evidence of charring; rather, the process resembles the sublimation of carbon dioxide. Although this may account for the non-fouling action of this particular polymer additive composition (the ideal drag reducer for product pipeline flow improvement), it is difficult to see how this property could improve combustion on its own.

The additive also prevents drying of injectors (when used with a light carrier distillate), and reduces flow resistance in the entire fuel system (drag reduction). It may also serve to lubricate parts in the fuel system, but these potential benefits are believed to be secondary to volumetric efficiency and combustion effects.

Tests of diesel trucks showed that combustion processes are improved when low concentrations of additive are used. Firing range tests on fuel containers at China Lake showed the elimination of the normally rapid and very smoky explosion when polymer additive was present. This was attributed to the suppression of sub 40 micron droplets in the sprayed fuel. It is well known that sub-10-micron droplets burn like a vapor, that droplets larger than 40 microns burn diffusively from droplet to droplet and that there is a transition range from 10 microns to 40 microns. A similar phenomenon may occur when diesel fuel is injected under high pressure into hot compressed air in a diesel engine cylinder. Improvement of the spray properties could then result in better combustion of the concentrated fuel cloud in the thin disk of hot compressed air in the cylinder and in the sustained injection period under load. The result could be more complete combustion of the hydrogen and carbon of the diesel fuel to water and carbon dioxide, especially under high-load and rapidly changing conditions.

Other features and advantages of the present invention will become apparent from the following description of the preferred embodiments of the invention.

DETAILED DESCRIPTION OF THE PREFERRED EMBODIMENTS

The preferred embodiments of the present invention all rely upon the addition of a high-molecular weight polymer to a hydrocarbon engine fuel for the purpose of changing the physical properties of the fuel in order to improve combustion efficiency. Experimental tests evidence a significant increase in fuel efficiency with the use of additive according to the present invention. Certain tests show increases of more than 20%.

Although the theory of operation is not known for certain, the increase in efficiency is believed to result from momentary changes in the physical properties of the fuel attributed to the introduced polymer. Accordingly, a brief discussion of the mechanical and physical effects of the additive on the fuel is believed to be appropriate.

Resting Viscosity of a Dilute Polymer Solution

The Newtonian (resting) viscosity of a very dilute polymer solution is close to that of the solvent. This is a consequence of the following two equations:

$$[\eta]=KM^{1/2} \text{ and} \quad \text{(i)}$$

$$\eta_{sp}=[\eta]c+k[\eta]^2c^2 \quad \text{(ii)}$$

where $[\eta]$ is the intrinsic viscosity of the polymer-solvent system, M is molecular weight, and K is the constant of proportionality. Note that $[\eta]$ is weakly dependent on molecular weight, thus the specific viscosity of a given solution concentration is also little increased by M. This is especially the case when the polymer concentration, c, is also small as it is for fuel additive at 10 ppm, or 0.0010 grams per deciliter. c is $1\times10^{-3}$ g/dl and $c^2$ is $1\times10^{-6}$ $g^2/dl^2$. Thus, the treated fuel is not very different from untreated fuel at rest.

Extensional Viscosity

The ratio of viscosity of stretched, elongated, or extended polymer solution to the viscosity of the unperturbed solution is given by $$\eta/\eta_o=3+\epsilon c\eta_o K^2M^{(1+2\alpha)}/RT \quad \text{(iii)}$$

The extensional viscosity, $\eta$, is strongly dependent on the molecular weight. The term $M^{(1+2\alpha)}$ becomes $M^2$ for the case of worst solvent for the polymer, and $M^3$ for the best possible solvent. Polyisobutylene and fuel are ideally compatible and the term more closely approaches $M^3$ than $M^2$. Despite the strong dependencies of $\eta/\eta_o$ on the molecular weight, $\eta/\eta_o$ approaches the low limiting value of 3 when c approaches 0. This is why the ratio can be "tuned" to a particular type of engine or burning condition (further discussions will be postponed to the next section).

The rate of strain, $\epsilon$, is a measure of elongation per unit length per second, or $\Delta L/L\Delta t$. This parameter changes when the solution is sheared, stretched, or deformed. Physically, the large polymer chains are deformed from a random coil conformation to a stretched chain conformation. In the absence of the strain, the chains thermally relax to the random coils. Often the strain induces a stress which breaks some of the extended molecules in the middle (mid-point break theory). However, in undergoing a break, the fluid is also most rigid. In other words, $\Delta L/L\Delta t$ is very large and $\eta/\eta_o$ is also maximized.

Regions where $\Delta L/L\Delta t$ are large include turbulent liquid flow regions (drag reduction effect), injection from a nozzle (cohesive effect), the interaction of a liquid stream of droplets with high velocity air. These conditions exist in most modern engines, especially when conditions are changing in the millisecond to microsecond domain.

K in this equation is obtained in the laboratory by plotting the log of the intrinsic viscosity against the log of the molecular weight and taking the slope of the line. K is constant for a particular polymer solvent system. The K for polyisobutylene in Benzene is $1.07\times10^{-3}$ at 297° K. T enters the expression for $\eta/\eta_o$ in the term 1/RT where R is the gas constant. T has little effect on $\eta/5\eta_o$, since there is usually little displacement from 298° K. (25° C.). T could be 273° K. (0° C.) or perhaps 325°, but the effect on $\eta/\eta_o$ is very small.

Effects on Fuel Properties

Under some conditions, $\eta/\eta_o$ can approach 10,000. When this is too large for an optimal effect on combustion or volumetric efficiency, or delayed vaporization, or suppression of vapor-like particles, the concentration can be decreased toward zero. Thus, it is always possible to tune the fuel for 2-cycle spark ignition, 4-cycle spark ignition, compression ignition, turbine or other combustion scenarios. c can also be changed for different carburetor or fuel injection systems. High molecular weight is an advantage because it generates large $\eta/\eta_o$ values at low concentrations where "at rest" fuel properties are virtually unaffected. There is no doubt that 5 to 10 ppm concentrations of $7.2\times10^6$M PIB decreases energy loss in turbulently flowing fuels, resulting in flow rate increase of more than 20%. There is also no doubt that the formation of vapor-like particles is suppressed at low concentrations of high molecular weight PIB. These two effects are related to $\eta/\eta_o$.

However, $\eta/\eta_o$ is also related to transient increases in the "solidity" and surface tension of particles produced by shear at surfaces or in turbulent air. Consider a sphere of isolated liquid in an inert atmosphere at constant temperature and pressure, with the radius larger than $10^{-6}$ cm. The number of molecules vaporizing from the surface of the sphere per second is given by $$dN/dt=4\pi rDn^{\circ} \quad \text{(iv)}$$

r is the radius of the droplet and D is the diffusion coefficient of molecules within the droplet. $n^o$ is the saturation vapor pressure at the interface of the drop with the gaseous atmosphere. $r_m$ is the molecular radius.

The link between D and $\eta$ is via the Stokes relationship or $$D=RT/n_o 6\pi\eta r_m \quad \text{(v)}$$

accumulating the constants and the radius of a molecule equation v becomes $D=k/\eta$, or for extensional viscosity $\eta$ $$D=k/\acute{\eta} \quad \text{(vi)}$$

Substituting vi into v yields $$dN/dt=4\pi kn^o/\eta$$

Thus, during periods close to those where $D\Delta L/L\Delta t$ is large, the rate of vaporization, Dn/dt is very depressed. Simultaneously the droplet is very rigid and solid like, and the surface is equally tense or hardened. When $\eta$ subsequently approaches $3\eta_o$, the rate of evaporation increases sharply. During the "hardened" phase both the surface tension and bulk viscosity of the droplet favor transport without coating or premature vaporization. This leads to improved performance in gasoline and diesel engines.

Another equation incorporates D and $\gamma$, or surface tension into the expression for the lifetime of a spherical droplet. This equation is $$t=(r^2 n_L/2Dn^o)(1-4\gamma/n_L rk_c T) \quad \text{(vii)}$$

where $n_L$ is the number of molecules per $cm^3$ in the liquid and r is the radius of the droplet. Again replacing D by $k/\eta$ we get $$t=r^2\acute{\eta}n_L)/(2kn^o)\ (1-4\gamma/n_L rk_c T) \quad \text{(viii)}$$

In equation (viii), the surface tension approaches 0 when saturated vapor is present above the droplet interface and $\gamma$ approaches 0. The droplet lifetime equation (viii) then becomes proportional to $\eta$.

Relation of PIB and $\eta$ $\eta$ becomes larger as $\epsilon$ increases. Similarly $\eta$ decreases as $\epsilon$ approaches zero. When the stretching force is released the extensional or elongational viscosity decreases. The increase or decrease in $\eta$ depends on the product of the strain $\epsilon$ and the reciprocal of the time it takes for the molecule to thermally relax to the unstretched conformation. The units of the stretching rate or elongation rate are reciprocal seconds and the units of polymer relaxation times are seconds. The product of the two factors is dimensionless. The following equation links $\eta$ to $\epsilon$ and $\theta$.

$$\eta=3\eta_o+(3cRT/M)\Sigma_p(\theta_p 1((1-2\epsilon\theta_p)\ (1+\epsilon\theta_p))$$

$\theta_p$ is the relaxation time of the p th normal mode of chain response. Note that as $\epsilon\rightarrow\frac{1}{2}\theta$, where $\theta$ is the longest relaxation time, the $(1-2\epsilon\theta_1)$ term approaches zero. As the denominator approaches zero, $\eta$ approaches infinite elongational viscosity. The relaxation time $\theta_1$ is proportional to $$[\eta]M\eta_{o/RT}$$

where $[\eta]$ is itself equal to $KM^{\alpha}$ and $\alpha$ is between 0.5 ($\theta$ solvent=poor solvent) and 1.0 (perfect solvent). Thus the relaxation time is proportional to $M^2\eta_o/RT$ in a good solvent. Relaxation time increases with $M^2$ and therefore a state of high $\eta$ will exist longer than it would for the case of a lower molecular weight. The mist particles would retain a high $\eta$ for a desirable period during engine operation. Since $\eta$ approaches $\infty$ when $\epsilon$ approaches $\frac{1}{2}\theta$ a high molecular weight polymer in a good solvent will develop an extensional viscosity that approaches infinity at lower extension rates than a low molecular weight polymer in a poor solvent. The former is the case for the fuel additive of the present invention in gasoline and diesel fuels. Concentration then provides the final tuning for the desired $\eta$ at a particular $\epsilon$.

SUMMARY

1. The large $\eta/\eta_o$ possible using low concentrations of $7.2\times10^6$M PIB in gasoline and diesel fuels influences pre-combustion events and thus affects combustion.

2. Through c, $\eta/\eta_o$ can be tuned to improve the operation of several types of engines.

3. $\eta/\eta_o$ changes are linearly dependent on concentration and $\Delta L/L\Delta t$ and this provides another dimension for engine tuning.

4. Through c, $\eta/\eta_o$ can be tuned to:

a. improve volumetric efficiency by slightly delaying vaporization (2-stroke and 4-stroke spark ignition engines);

b. negate undesirable surface coating effects through momentary increases in surface and bulk rigidity;

c. improve uniformity of vaporization of gasoline droplets;

d. promote diffusive burning (diesel);

e. develop a uniform cloud mix for improved combustion (diesel); and f. promote diesel fuel jet penetration prior to ignition and diffusive burning.

Various embodiments of the present invention will be described and discussed in detail below with respect to the following examples:

EXAMPLE 1

Sixteen grams of ultra high molecular weight polyisobutylene, coated with polyethylene wax (designated as Oppanol® B246 by the supplier BASF) was cut into approximately ⅛" pieces. The pieces were cut from the center of each PIB pellet to reduce the amount of polyethylene wax that would be carried into the initial solutions. The pieces of polymer were added to 800 grams of isooctane. The container containing the polymer and the solvent was stirred with a flat blade for 24 hours. The resulting solution (hereafter referred to as PIB stock solution) contained 2% polyisobutylene (Oppanol® B246). 800 grams of the PIB stock solution was then combined with 800 grams of Exxon 100 Solvent Neutral Oil to form a final additive blend of 50% PIB stock solution, and 50% Solvent Neutral Oil. The additive mix was then put into 2 ounce containers. The additive was added to the fuel tank of a 1980 Nissan 280ZX prior to filling the fuel tank at a service station. It was added at the rate of 2 ounces to 10 gallons of fuel. Gasoline was then added to the tank to promote mixing. The Nissan 280ZX showed immediate improved performance in both acceleration and engine smoothness and gave gasoline mileage improvement.

EXAMPLE 2

The PIB stock solution as described in Example 1 was blended at a rate of 16 ounces of the PIB solution to 16 fluid ounces of Exxon 100 Solvent Neutral Oil. The mixture was then diluted with 10.7 ounces of Amoco super unleaded. The final mixture was added to 2 ounce bottles. The additive was added to the fuel tank of an Oldsmobile having a Quad engine. Gasoline was then pumped into the tank to promote mixing. The Quad 4 showed a significant increase in gasoline mileage and engine smoothness immediately.

EXAMPLE 3

The PIB solution was prepared as in Example 1 except the 16 grams of PIB was added to 800 grams of Amoco Super Unleaded 93 octane. The PIB solution was mixed 50%–50% by volume with Exxon 100 Solvent Neutral. The additive was then added to the 280 ZX described in Example 1. The additive was added directly to the fuel tank after filling. The additive was added at a rate of 2 ounces to 10 gallons. The vehicle showed more power, smoother engine, and better gas mileage.

EXAMPLE 4

The same PIB base stock solution used in Example 3 was used in a Ford Cosworth racing car. The amount of fuel needed for the race was calculated and was added to the vehicle's fuel tank. The additive was added to the fuel tank at a rate of 2 ounces per 10 gallons of fuel. The vehicle ran the race at its maximum speed. At the end of the race the fuel tank was drained and 2½ gallons of fuel were removed. The driver estimated an improvement in fuel consumption of more than 20%.

EXAMPLE 5

The same PIB base stock solution used in Example 3 was used in the tow truck that transported the race car in example #4. The fuel mileage was calculated on the original trip to the race track. Additive was added to the tow truck at a rate of 2 ounces per 10 gallons of fuel. On the return trip an increase in fuel mileage of more than 25% was recorded.

EXAMPLE 6

The PIB solution as described in Example 1 was blended at a rate of 32 ounces to 32 ounces of Sunpar LW 100 base stock. The resulting material was put into 2 ounce containers. The additive was added to a 1992 Nissan 300ZX and acceleration and mileage tests were conducted by EG&G Automotive Research Center on a runway in San Antonio, Tex. The 300ZX showed significant improvement in rate of acceleration and fuel consumption.

EXAMPLE 7

The PIB solution of Example 6 was used to prepare fuel samples for octane number testing. Three fuel samples were prepared. Sample Number 1 was one gallon of Mobil 87 gasoline. Sample Number 2 was made by adding 2.96 ml of the PIB solution to one gallon of Mobil 87 Octane gasoline. Sample Number 3 was made by adding 5.920 ml of the PIB solution to one gallon of Mobil 87 Octane gasoline. The three samples were submitted to Penniman and Brown Laboratories in Baltimore, Md. to test for octane number. Sample Number 2 increased the research octane number by 7% (R). The motor octane number did not change. R+M/2, the octane indicator at the pump, was increased by 4%. Sample Number 3 decreased the R number by 1%. The M number for sample 3 did not change. R+M/2 was decreased by 0.06%.

EXAMPLE 8

The PIB stock solution in Example 1 was diluted with an equal part of gasoline. The resulting solution was added to 2 ounce containers. The additive containing no base stock was then added to an Audi 4000. Prior to fueling a 2 ounce container of additive was added to the fuel tank and 10 gallons was added. The engine steadied and an increase in power was immediately noticed.

EXAMPLE 9

The additive blend of Example 6 was added to gasoline at a concentration of 1 ounce of additive to 5 gallons of gasoline. The additive/gasoline mixture was then added to the fuel tank of a 1976 12 horsepower Wheelhorse lawn and garden tractor. The engine ran smooth and steady. The tractor also started to run rich. The carburetor had to be turned back to the factory original settings.

EXAMPLE 10

The additive blend of Example 6 was blended with a premeasured amount of a 40:1 2 cycle engine oil. The final solution was added to a Toro weed trimmer. The Toro weed trimmer had a history of hard starting and excessive smoke while running. The operator immediately noticed a considerable reduction in exhaust smoking. Upon retesting the trimmer, the operator also noticed an easier start from both cold and warm starting.

EXAMPLE 11

The PIB stock solution of Example 1 was diluted with an equal part of Amoco Super Unleaded 93 Octane gasoline. The solution was then added to gasoline at a rate of 2 ounces to 10 gallons. The additive/fuel mixture was used with a 1978 40 horsepower Johnson outboard motor mounted on a 14' by 8' pontoon boat. There was a significant increase in the range of the vessel along with a reduction of blue exhaust smoke.

EXAMPLE 12

Sixteen grams of ultra high molecular weight polyisobutylene, coated with polyethylene wax, designated as Oppanol® B246 by the supplier BASF was cut into approximately ⅛" pieces. The pieces were cut from the center of each PIB pellet to reduce the amount of polyethylene wax that would be carried into the initial solutions. The pieces of polymer were added to 800 grams of diesel fuel. The container containing the polymer and the solvent was stirred with a flat blade for 24 hours. The resulting solution (hereafter referred to as PIB stock solution) contained 2% Oppanol® B246. Eight hundred grams of the PIB diesel stock solution was then combined with 800 grams of Exxon 100 Solvent Neutral Oil to form a final additive blend of 50% PIB diesel stock solution and 50% Solvent Neutral Oil. The additive was diluted by 10.7 ounces of neat diesel. The additive was used in a fleet of Kenworth tractor trailers at a rate of 2 ounces of additive to 10 gallons of diesel fuel. There was an average of 9% increase in miles per gallon.

EXAMPLE 13

The PIB solution as described in Example 1 was blended at a rate of 32 ounces to 32 ounces of Sunpar LW 100 base stock. The additive example of this example was used in an EPA standard HWFET emissions test on a chassis dynamometer at Environmental Research and Development, Inc., located in Gaithersburg, Md. The test vehicle was a 1987 Nissan 300 ZX with more than 180,000 miles on the engine and catalytic converter. The vehicle was first tested with untreated 87 octane (regular) Mobil gasoline (summer oxygenated blend). The fuel was then treated at the level of 2 fluid ounces of additive composition and a second HWFET emissions report was generated. The following emission changes were seen between the untreated and treated fuel tests: 1) 21.2% decrease in grams of hydrocarbon per mile; 2) 60.9% decrease in grams of CO per mile; 3) 62.8% increase in the NOX per mile; 4) 1.9% decrease in grams of carbon dioxide per mile. The decrease in carbon dioxide per mile shows an increase in miles per gallon under highway driving conditions. The changes in emissions data show improved combustion.

EXAMPLE 14

Polyisobutylene with a viscosity average molecular weight of 7.2 million Daltons was cryogenically ground with magnesium stearate as a coating agent. 0.953 grams of this powder were added to 162.5 grams of Exxon 150 base neutral oil stirred at 450 rpm. After 10 minutes of mixing at 450 rpm the speed was decreased to 60 rpm. This was equilibrated overnight to a solution which was 0.5049% PIB by weight and also contained 759 ppm magnesium stearate and 29 ppm polyethylene wax. This PIB solution was not used in vehicle testing, and is included as an example of solution manufacture suitable for the preparation of a gasoline additive of this invention.

EXAMPLE 15

0.953 grams of the powder in Example 14 were added to 5.319 grams of absolute methanol to make slurry wetted with non-solvent. 87 grams of Exxon 100 Base Neutral Oil were added to the slurry and the mixture was stirred at 260 rpm for 4.5 hours. The resulting solution was very homogenous and very viscoelastic. The concentration of PIB was 0.532% by weight, with 799 ppm of magnesium stearate and 31 ppm of polyethylene wax. This solution was used in tests of a 1987 Nissan 300 ZX and a 1983 Nissan 280 ZX. The tests on these two vehicles were conducted over essentially the same driving circuit from Apr. 7, 1995 to May 2, 1995. Both vehicles showed increased miles per gallon (mpg) and increased performance, especially improved acceleration from a stop. The vehicles showed increased mpg (over 10%) in the PIB concentration range (in the gasoline) from 0.4 ppm to 16.43 ppm. The highest percent mpg increase was 25 for the 280 ZX and 22.5 for the 300 ZX. Of 12 separate tests on both vehicles the treated fuel always provided more mpg over the untreated fuel without exception. Decreasing the PIB concentration always led to degraded performance and decreased mpg.

EXAMPLE 16

PIB with a viscosity average molecular weight of 7.2 million Daltons was cryogenically ground with magnesium stearate as a coating agent. The powder was sequentially sieved through a 425 micron sieve, a 250 micron sieve, and a 200 micron sieve. The powder between the 425 and 250 micron sieves was used to make a solution of PIB in Exxon 100 base neutral oil as follows: 44.45 grams of powder were added over a period of 2 minutes to 729.6 grams of oil stirred at 1,526 rpm. After all of the powder had been added, the mixer speed was decreased to 450 rpm, and decreased thereafter in intervals over a period of 20 minutes. The viscoelasticity was strongly evident at the end of this mixing procedure. The sample was then transferred to a wide-mouth bottle to come to equilibrium as a viscoelastic gel stock solution. The PIB powder concentration was 5.735% by weight. This PIB solution was not used in vehicle testing, and is included as an example of solution manufacture suitable for the preparation of a gasoline additive of this invention.

EXAMPLE 17

The powder fraction below the 250 micron sieve was used to prepare a solution of PIB in Exxon 100 base neutral oil as follows: 25.237 grams of powder were added over a period of 2 minutes to 665.7 grams of oil stirred at 1,000 rpm. The solution was stirred at 1,000 rpm for 25 minutes. It was then stirred for 4.5 hours at 60 rpm and then poured into a wide-mouth bottle for equilibration to a viscoelastic gel stock solution. The PIB powder concentration was 3.653% by weight. This PIB solution was not used in vehicle testing, and is included as an example of solution manufacture suitable for the preparation of a gasoline additive of this invention.

EXAMPLE 18

The 5.735% PIB viscoelastic gel stock solution was used to prepare a fluid suitable for rapid diffusion into gasoline or diesel fuel as follows: 16.44 grams of the stock solution were added to 98.1 grams of Exxon 100 base neutral oil stirred at 70 rpm for 3.5 hours. The concentration of the resulting solution was 0.806%. The resulting dilute PIB solution was not used in vehicle testing and is included as an example of solution manufacture suitable for the preparation of a gasoline additive of this invention.

EXAMPLE 19

37.96 grams of cryogenically ground and coated 7.2 million Dalton PIB was dissolved in one gallon of a commercially available top cylinder oil (Marvel). The powder was slowly added to one gallon of slowly stirred oil in a stainless steel mixing bowl under a Sunbeam Mix Master fitted with a counter rotating "egg beater" blades. The mixer was set at its lowest speed. The powder was introduced at the pulling section of the inter-meshing blades while the bowl was also slowly rotated. This method provided excellent wetting and dispersion of the PIB powder in the oil. The mixer was run for an additional 10 minutes after adding all of the powder. The mixture was then transferred to a transparent one gallon container for observation over a period of two days. The homogeneous additive solution was then transferred to a one gallon steel container. This additive has been continuously used in four vehicles: the two vehicles in example #4, a 1992 Ford Mustang (5 L), and a 1987 Nissan Maxima. The owner of Mustang also tested the additive in a four cylinder Honda motorcycle. Increased performance coupled with increased mpg was seen in all of the automobiles, with increases in mpg in the range of 10 to 20 percent. The motorcycle showed a 20% increase in mpg at the same high level of performance (a racing style bike). No detrimental effects have been observed in long-term, continuous use in any of the vehicles in this example.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method of improving the combustion efficiency of a fuel-burning device comprising adding an effective amount of a polymer having a molecular weight greater than about 4 million daltons to the fuel of the fuel-burning device and burning the fuel with the polymer in the fuel-burning device.

2. The method of claim 1, wherein the polymer is polyisobutylene having a molecular weight of about 6.3 million daltons.

3. The method of claim 2, wherein the polyisobutylene is added to the fuel in a concentration range between 0.1 to 100 ppm by weight.

4. The method of claim 2, wherein the polyisobutylene is added in a concentration range between 1 to 20 ppm by weight.

5. The method of claim 1, wherein the fuel-burning device is selected from the group consisting of gasoline engines, diesel engines, furnaces and burners.

6. The method of claim 1, wherein the fuel-burning device requires no modifications beyond adjustments of mixture ratios.

7. The method of claim 1, wherein the polymer is polyisobutylene having a viscosity average molecular weight of about 7.2 million daltons.

8. A method of improving the combustion efficiency of a fuel-burning device comprising adding a polymer having a viscosity average molecular weight of above about 4 million daltons to the fuel of the fuel-burning device.

9. The method of claim 8, wherein the polymer comprises polyisobutylene.

10. The method of claim 8, wherein the polymer is added to the fuel in a concentration range between 0.1 to 100 ppm by weight.

11. The method of claim 1, wherein the effective amount of the polymer is added to a fuel tank of the fuel burning device.

12. The method of claim 11, wherein the effective amount of the polymer is added to the fuel prior to adding the fuel to the tank of the fuel burning device.

13. The method of claim 8, wherein the polymer is added to a fuel tank of the fuel burning device.

14. The method of claim 13, wherein the polymer is added to the fuel prior to adding the fuel to the fuel tank of the fuel burning device.

15. The method of claim 1, wherein the polymer is polyisobutylene having a molecular weight of 7.2 million daltons.

16. The method of claim 8, wherein the polymer is polyisobutylene having a molecular weight of about 6.3 million daltons.

17. The method of claim 1, wherein the polymer has a molecular weight greater than about 5 million daltons.

* * * * *